United States Patent [19]

Coers et al.

[11] Patent Number: 4,506,508

[45] Date. of Patent: Mar. 26, 1985

[54] APPARATUS AND METHOD FOR CONDENSING STEAM

[75] Inventors: Don H. Coers; John T. Crawford, both of Naperville, Ill.

[73] Assignee: Chicago Bridge & Iron Company, Oak Brook, Ill.

[21] Appl. No.: 478,655

[22] Filed: Mar. 25, 1983

[51] Int. Cl.[3] ..... F01K 9/00

[52] U.S. Cl. ..... 60/652; 60/688; 60/659; 60/692; 60/693; 165/1; 165/110; 165/DIG. 1; 62/270

[58] Field of Search ..... 60/693, 692, 659, 652; 165/110, DIG. 1, 107, 45, 1; 62/115, 506, 270

[56] References Cited

U.S. PATENT DOCUMENTS

| | | | |
|---|---|---|---|
| 3,681,920 | 8/1972 | Margen | 60/652 |
| 3,731,488 | 5/1973 | Sasakura et al. | 165/DIG. 1 |
| 3,820,334 | 6/1974 | Heller et al. | 165/DIG. 1 |
| 3,935,902 | 2/1976 | Heller et al. | 165/DIG. 1 |
| 4,270,358 | 6/1981 | Hausain et al. | 60/693 |
| 4,296,802 | 10/1981 | Larinoff | 60/693 |
| 4,315,404 | 2/1982 | Schmitt et al. | 60/692 |
| 4,449,368 | 5/1984 | Haynie | 60/652 |

FOREIGN PATENT DOCUMENTS

| | | | |
|---|---|---|---|
| 15702 | 1/1983 | Japan | 60/652 |

*Primary Examiner*—William R. Cline
*Assistant Examiner*—John K. Ford
*Attorney, Agent, or Firm*—Marshall, O'Toole, Gerstein, Murray & Bicknell

[57] ABSTRACT

Condensing exhaust steam by conveying a stream of the exhaust steam under vacuum to a base cooling tower to condense the steam so long as the heat rejection capacity of the base cooling tower is adequate to condense the steam; supplementing the base cooling tower, when it provides inadequate cooling, by contemporaneously also withdrawing cold cooling water from a cold water reservoir and injecting the cooling water into the stream of exhaust steam under vacuum to condense a portion of the steam to water such that the remaining portion of the steam is condensed to water in the base cooling tower; withdrawing hot condensed water from the exhaust steam stream and feeding a portion thereof to a hot reservoir; withdrawing hot cooling water from the hot reservoir, when the cooling tower capacity is adequate to decrease the temperature of the exhaust steam to below the temperature of the hot cooling water in the hot reservoir, and subjecting the withdrawn hot cooling water to the exhaust steam vacuum to cool the hot cooling water by converting part of the water to steam; and feeding the so-cooled cooling water to the cold water reservoir.

16 Claims, 3 Drawing Figures

APPARATUS AND METHOD FOR CONDENSING STEAM

This invention relates to apparatus and methods of cooling and/or condensing exhaust steam from an industrial power plant. More particularly, this invention pertains to apparatus and methods of cooling and/or condensing exhaust steam under vacuum using supplementary or peak shaving cooling water which supplies necessary additional cooling when a base cooling system maximum capacity or duty is exceeded, such as on hot days, and subsequently cooling the resulting hot cooling water by feeding it to the exhaust steam stream when the exhaust steam is at a lower temperature, such as at nighttime, than the hot cooling water.

BACKGROUND OF THE INVENTION

Many commercial and industrial processes generate large amounts of waste heat which must be removed for successful operation. The waste heat is often carried in the form of a hot fluid stream. For a number of reasons, it is often undesirable or impermissible for the hot fluid stream to be disposed of, so it must be cooled and reused. One such hot fluid stream is exhaust steam, such as from an electric power generating steam turbine, which is condensed to water which then is reconverted to steam in a boiler to be used again in powering the turbine.

A base cooling system of one type or another is provided for cooling the hot exhaust steam. All such systems rely, ultimately, on heat rejection to the environment, either by direct rejection, or indirectly through an intermediate fluid, to air or to water from a river, lake or sea.

A typical cooling system can be illustrated further by reference to a power generating plant. In the production of electric power, heat is first produced by any suitable means such as nuclear energy, geothermal, solar, or combustion of a fossil fuel such as oil, gas or coal. The heat produced is then used to convert water into steam. The steam is conducted at high pressure to a turbine which it drives. The turbine is, of course, coupled to a generator which produces electric power. The spent steam from the turbine is condensed by the cooling system and then the water is recycled and reheated to steam again.

An air-cooled system is generally designed and built to provide a cooling capacity or duty adequate for the intended purpose on the hottest day, or ambient temperature, anticipated at the site of the plant involved. This results in an excess cooling capacity for all but a small number of days out of a year. Even on the hottest days, the maximum cooling capacity of the system often is not utilized except during the very warmest part of the day. This is because the atmospheric temperature from day to night will vary as much as, or more than, 20° to 30° F., making it unnecessary to utilize the maximum cooling capacity of the system most of each day. The cooling system installation, operation and maintenance involve large costs and expenses which cover a system that is not anywhere fully employed, regardless of the hot fluid stream to be cooled.

A water cooled system is generally designed for the highest temperature of the water from the available source e.g. river, lake or sea. The cooling water picks up heat in condensing the steam. The heated cooling water is disposed of into the river, lake or sea.

As an alternative, many power generating plants cool the heated cooling water in an evaporative cooling tower by contacting it with ambient air. Large natural or mechanical draft cooling towers are extensively used for this purpose. Although the heated water is cooled in this manner, a substantial amount is expelled as water vapor which may form artificial clouds leading to fog, ice and other problems, in addition to the loss of increasingly scarce fresh water.

An evaporator cooling tower serving a 1000 megawatt electric generating plant may lose as much as 600,000 gallons of water per hour into the atmosphere. Also, the evaporator towers are susceptible to a large growth of bacteria, causing additional environmental problems.

Various dry-type cooling systems have also been proposed. Some of the these use indirect heat rejection, such as to ammonia, as is disclosed in U.S. Pat. Nos. 4,270,358 and 4,315,404. Other systems employ combinations of direct and indirect systems for condensing exhaust steam as disclosed, for example, in U.S. Pat. Nos. 3,831,667; 3,935,902; and 3,841,100. In the direct cooling aspect of such systems, cooling water is injected directly into contact with the hot exhaust steam after it flows from the turbine under vacuum. The resulting hot cooling water must then be cooled for further use in condensing steam. One way is to pass the hot cooling water through heat exchangers in a cooling tower. Such heat exchangers are expensive and undesirably increase the capital cost of a power generation plant. Furthermore, the cooling tower must be sized in such a system to handle the maximum heat rejection load which may be reached only a few times per year.

While U.S. Pat. Nos. 4,270,358 and 4,315,404 disclose indirect cooling systems for condensing exhaust steam, they also disclose a peak shaving system which can be placed in operation when the heat rejection load exceeds the design capacity of the cooling tower. The peak shaving system employs cooling water, which is stored in a cold reservoir, to help indirectly condense the steam at peak loads. The resulting hot cooling water is then fed to a hot reservoir where it is stored until it can be cooled for reuse. One way to cool the hot cooling water is to pass it through heat exchangers in the cooling tower when there is excess heat rejection capacity available in the cooling tower, such as at nighttime. While such a system is practical, it still involves very high capital investment cost in the cooling tower and ancillary equipment.

SUMMARY OF THE INVENTION

According to one aspect of the invention, there is provided a method of condensing exhaust steam, such as from a steam driven turbine, comprising conveying a stream of the exhaust steam under vacuum to a base cooling means to condense the steam in the base cooling means so long as the heat rejection capacity of the cooling means is adequate to condense the steam; supplementing the cooling capacity of the base cooling means, when it provides inadequate cooling to condense the steam, by contemporaneously also withdrawing cold cooling water from a cold water reservoir and injecting the cooling water into the stream of exhaust steam under vacuum to thereby condense a sufficient portion of the steam to water such that the remaining portion of the steam is condensed to water by the base cooling means; withdrawing hot condensed water from the exhaust steam stream and feeding at least a portion thereof to a hot reservoir; withdrawing hot cooling water from the hot reservoir, when the capacity of the base cooling means is at least adequate to decrease the temperature of the exhaust steam stream to below the temperature of the hot cooling water in the hot reservoir, and subjecting the withdrawn hot cooling water to the exhaust steam vacuum to thereby cool the hot cooling water by converting part of the water to steam; and feeding the so-cooled cooling water to the cold water reservoir.

Especially important in the process is the step of cooling the hot cooling water, which results from its use in peak shaving, by using the exhaust steam partial vacuum when it is colder than the hot cooling water, to cool the hot cooling water. This permits construction of a cooling system with a minimum capacity base cooling means, such as a dry cooling tower with natural or forced draft which uses ambient air as the cooling means.

Generally, the exhaust steam temperature will be about 110° to 180° F. at 5 to 15 inches of mercury absolute pressure when the cold cooling water is used during peak shaving to condense the steam, and the exhaust steam temperature will be about 120° to 150° F. when the hot cooling water is cooled by expansion to the steam vacuum, provided that the hot cooling water is hotter than the exhaust steam used to cool it.

There are several ways in which the hot cooling water can be injected or sprayed into the colder exhaust steam stream at any suitable location. One way is to withdraw hot cooling water from the hot reservoir and inject it directly into the steam vacuum. Another way is to withdraw the hot cooling water from the hot reservoir and expand it through a turbine having its outlet in communication with the vacuum of the exhaust steam. The turbine or expander can be used to drive an electrical generator.

It is expected that in most instances it will be desirable for the portion of hot condensed water withdrawn from the exhaust steam stream and fed to the hot reservoir to be approximately equal to the amount of cold cooling water injected into the exhaust steam.

According to a second aspect of the invention, there is provided apparatus comprising a base cooling means; means for delivering an exhaust steam stream under vacuum into heat exchange communication with the base cooling means; a hot reservoir for cooling water when hot; a cold reservoir for cooling water when cold; means for withdrawing cold cooling water from the cold reservoir and feeding cold cooling water into the exhaust steam to condense a portion of the steam when the cooling capacity of the base cooling means is inadequate to cool all the exhaust steam; means for withdrawing hot condensed water from the exhaust steam stream and feeding it to the hot reservoir; means for withdrawing hot cooling water from the hot reservoir when the temperature of the exhaust steam stream decreases to below the temperature of the hot cooling water in the hot reservoir and delivering the hot cooling water to the exhaust steam stream under vacuum to thereby cool the hot cooling water; and means for delivering the resulting cold cooling water to the cold reservoir.

The base cooling means will generally include a natural or forced draft cooling tower and the steam can be condensed by direct or indirect heat exchange. In direct heat exchange, the steam will be fed directly to the cooling tower to be condensed by heat rejection to ambient air.

The hot and cold reservoirs can be in separate bodies or tanks or in the same tank. Since hot water stratifies on top of cold water, a single tank can hold all the water needed, whether all hot, all cold or in hot and cold layers.

The means for withdrawing hot condensed water from the exhaust steam stream desirably includes a conduit dimensioned to withdraw at least an amount of such water approximately equal to the amount of cooling water injected into the exhaust steam.

The described apparatus will usually include means for withdrawing hot condensed water from the exhaust steam stream and delivering it to a steam boiler.

It is also desirable in an important variation of the apparatus to have the means for withdrawing hot cooling water from the hot reservoir and delivering it to the exhaust steam stream include a turbine through which the hot cooling water can flow and be partially flashed to steam thereby cooling the hot cooling water. The turbine exhaust stream will be separated into steam and cold cooling water streams, so that means can be included to deliver the cold cooling water from the turbine outlet to the cold reservoir or elsewhere and to feed the steam from the turbine to the cooling tower.

DETAILED DESCRIPTION OF THE DRAWINGS

To the extent it is reasonable and practical the same numbers will be used on the various views of the drawings to identify the same or similar parts or elements.

Figure 1:
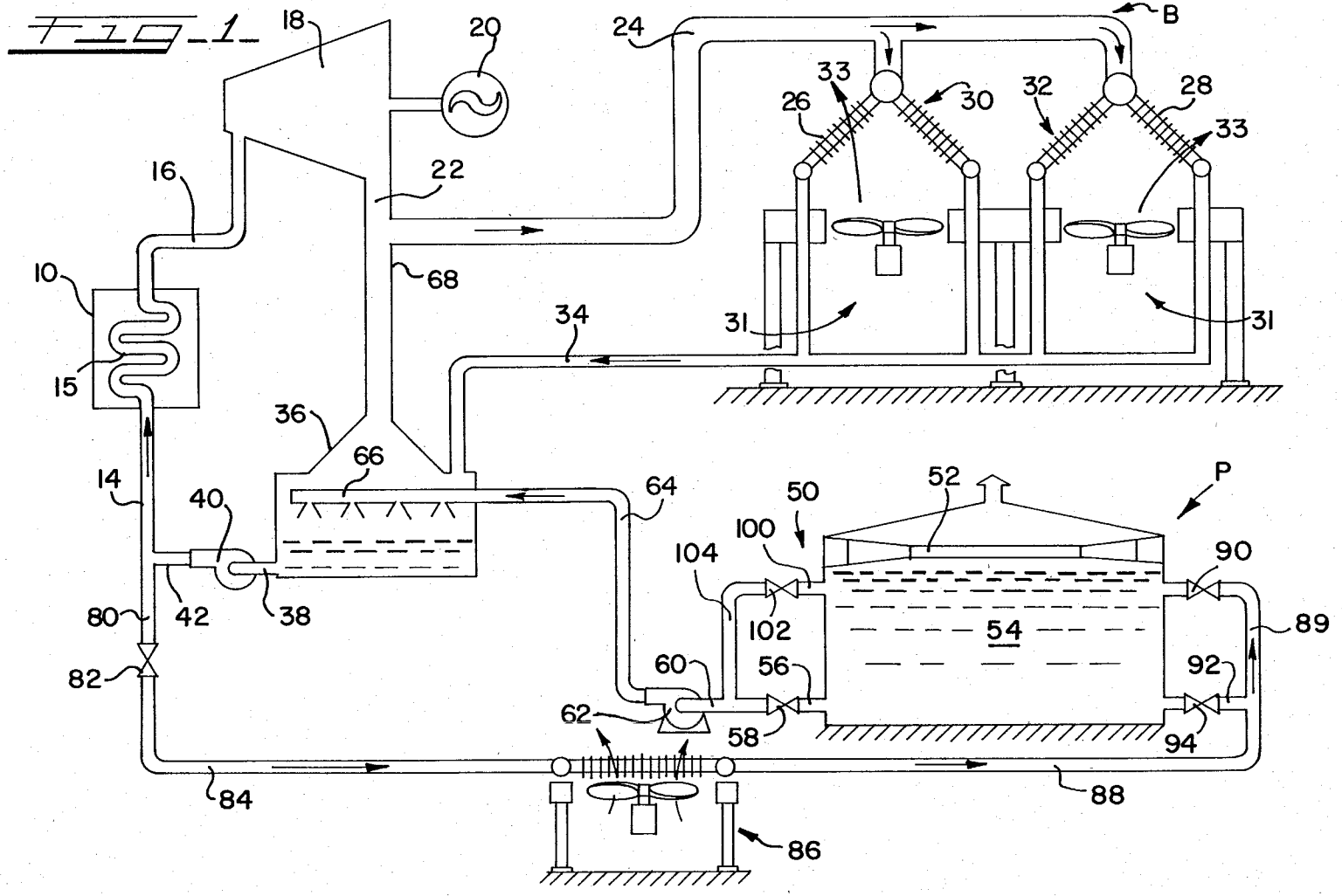
FIG. 1 is a diagrammatic drawing illustrating broadly a combination of apparatus provided by the invention for peak shaving cooling by directly condensing exhaust steam in an electric generating plant using a reservoir of cold water for peak shaving and for cooling part of the hot water so produced by feeding it to the exhaust steam vacuum.

With reference to FIG. 1, boiler 10 contains a heat exchanger 15 to which boiler quality water is fed by conduit 14. The water is converted to high pressure steam in the heat exchanger 15 and flows from it to steam conduit 16. The high pressure steam is fed by steam conduit 16 to steam turbine 18 which is operatively connected to drive electric generator 20.

A base cooling sytem B is provided to serve as the primary means for condensing exhaust steam which flows from the turbine 18 to steam conduit 22. The base cooling system B, however, is designed and sized to provide less than all the cooling duty required to cool the exhaust steam, such as when the temperature is above a pre-determined average summer temperature. On those days during the year when the base cooling system B is inadequate to cool the exhaust steam, the necessary additional cooling capacity is provided by a supplemental or peak shaving cooling system P.

When the base cooling system B is fully adequate to condense all of the exhaust steam itself, all of the exhaust steam is fed by steam conduit 22 to steam conduit 24 which feeds it to heat exchangers 26 and 28 in forced draft cooling towers 30 and 32 respectively. The exhaust steam is fully condensed in cooling towers 30 and 32 by heat rejection to ambient air 31, blown through the cooling towers, which exits as warm air 33. Although two cooling towers are illustrated, one tower or more than two towers can be used. Also, natural draft cooling towers can be used.

The condensed steam is withdrawn from cooling towers 30 and 32 by liquid conduit 34 and fed to steam box 36. The boiler quality cool water is removed from steam box 36 by conduit 38 in communication with pump 40. Pump 40 delivers the water to liquid conduits 42 and 14 which then feeds it to boiler 10 to complete the steam generating and condensing cycle.

At those times when the base cooling system B is inadequate to condense all of the exhaust steam, the peak shaving cooling system P is activated. The peak shaving cooling system P includes an enclosed storage tank 50 comprising a means of preventing air from contacting the stored water 54, such as floating roof 52. In peak shaving cooling, cold water is removed from the bottom of tank 50 through liquid conduit 56 and is fed through open valve 58 to conduit 60 for delivery to pump 62. Pump 62 feeds the cold water to liquid conduit 64 which communicates with steam box 36. Since the hot well is in vaccum, pump 62 may not be required because the liquid head and vacuum of the hot well may provide sufficient driving force. Instead of pump 62 a control valve may be used. The cold water is sprayed from the end 66 of conduit 64 into the steam box into contact with uncondensed exhaust steam. This exhaust steam is fed to the steam box by means of steam conduit 22 which feeds it to steam conduit 68, from which the exhaust steam flows into steam box 36. During peak shaving cooling, not all of the uncondensed exhaust steam is diverted from steam conduit 22 to steam conduit 68. Probably 80 to 90% of the exhaust steam will still be directed to steam conduit 24 for delivery to the cooling towers 30 and 32 for condensation there.

The amount of water used in condensing exhaust steam is separated from liquid conduit 42 and diverted to conduit 80. This hot water is fed through valve 82 now open to conduit 84 which feeds it through optional water chiller 86. The water chiller 86 is not put in operation during peak shaving cooling unless the ambient air temperature is low enough to obtain heat exchange therewith which lowers the water temperature. The water exiting chiller 86 is fed to conduit 88 which delivers it to conduit 89 with valve 94 closed. The hot water is fed by conduit 89 through valve 90 now open into the upper portion of the water volume in tank 50.

After the need for peak shaving cooling has been ended a large part, if not all, of the water in tank 50 will be hot. Before it can be used again for peak shaving it must be cooled. Generally, the best time to cool the hot peak shaving cooling water is at nighttime since the air temperature drops appreciably almost everywhere at night. Additionally, the base cooling system has excess cooling capacity at night so that the exhaust steam pressure will usually be lower as, for example, 6"HgA rather than perhaps 10"HgA, which means that the turbine is operating more efficiently leading to greater electric generation.

The hot peak shaving cooling water is cooled according to the invention by withdrawing the hot water from tank 50 by conduit 100 and feeding it through valve 102 now open to conduit 104. The hot water is delivered by conduit 104 to conduit 60 with valve 58 now closed. The hot water is fed by conduit 60, to optional pump 62 which feeds it to conduit 64. The hot water exits the end 66 of conduit 64 into steam box 36. In this way, the hot cooling water is subjected to the exhaust steam vacuum, resulting in flashing of the hot cooling water to steam, thereby cooling the remainder of the water. Cooling of the hot cooling water in this manner can be effected when the capacity of the cooling tower is at least adequate to decrease the temperature of the exhaust steam stream to below the temperature of the hot cooling water in the tank 50. Steam which forms from the described flashing can flow through conduit 68 to conduit 24, then to heat exchanger 26 and/or 28 where it is condensed.

The peak shaving cooling water which is cooled as described is withdrawn from steam box 36 through conduit 38, pump 40, and conduit 42 mixed with water from condensed steam. Mixing presents no problems since the peak shaving cooling water is of boiler quality.

An amount of water approximately equal to that withdrawn from tank 50 is diverted from conduit 42 to conduit 80. The cold peak shaving cooling water is fed from conduit 80, through optional chiller 86, to conduit 88 which delivers it to conduit 92 (with valve 90 closed) through valve 94 now open into the lower part of tank 50.

The described combination of apparatus is particularly useful when the exhaust steam temperature is about 120° to 180° F. at 5 to 15 inches of mercury pressure absolute when cold peak shaving cooling water is used to condense the steam, and the exhaust steam temperature is about 120° to 150° F. when the hot cooling water is cooled by the steam, provided that the hot cooling water is hotter than the exhaust steam used to cool it.

Figure 2:
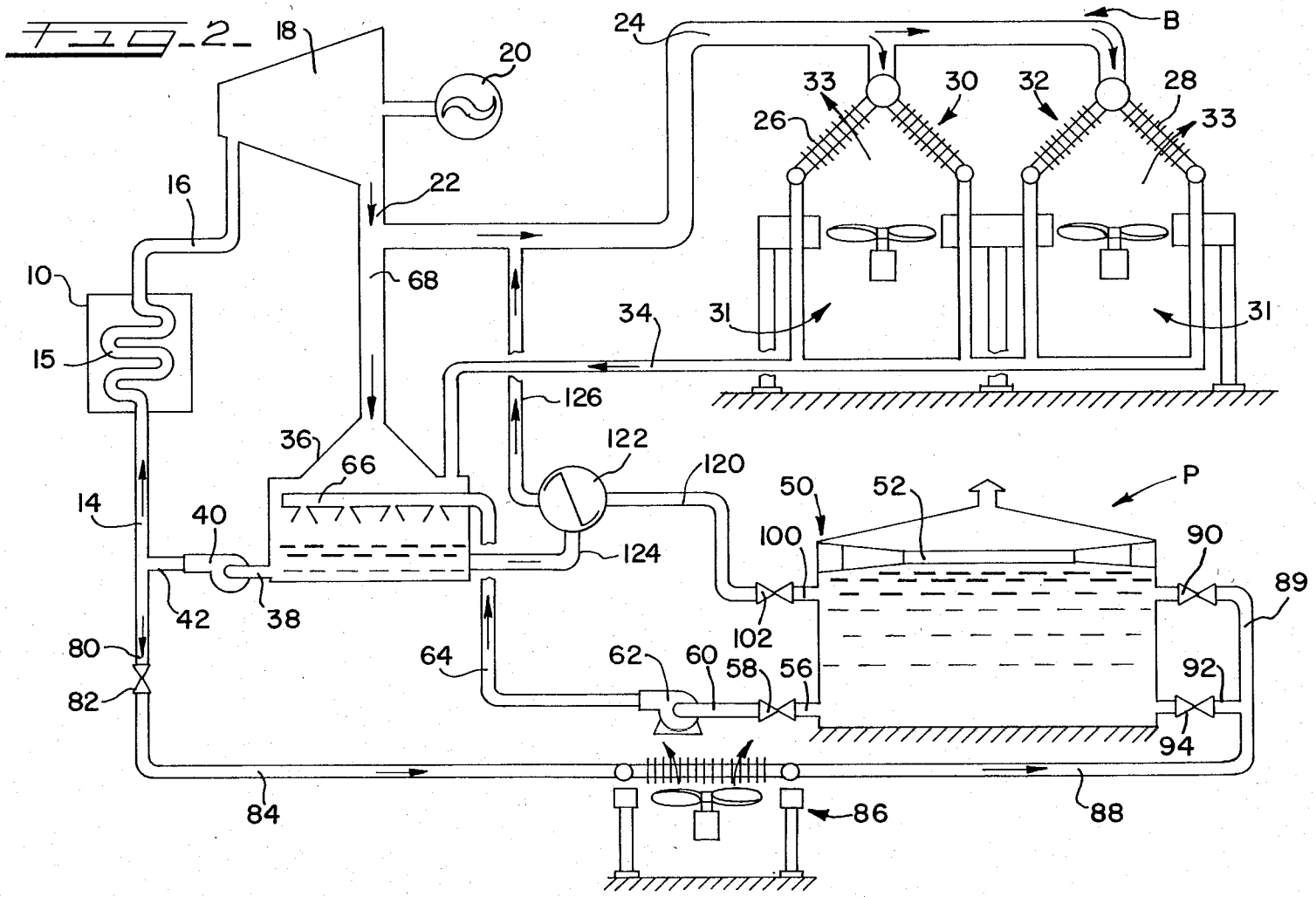
FIG. 2 is similar to FIG. 1 except that the hot water is cooled by expansion through a turbine to the exhaust steam vacuum.

With reference to FIG. 2, it will be seen that the combination of apparatus illustrated diagrammatically in that figure is very similar to that of FIG. 1. Accordingly, the subsequent discussion will be limited to the parts and elements found in FIG. 2 which are not present in FIG. 1.

As shown in FIG. 2, the conduit 100 for withdrawing hot peak shaving cooling water from tank 50 feeds it through valve 102, now open, to liquid conduit 120 for delivery to turbine or expander 122. Part of the hot water is flashed in turbine 122 because it is in operative communication through steam conduit 126 to steam conduit 24. As a result, the hot liquid supplied by conduit 120 is subjected to a substantial pressure drop, such as about 12–13 psi, which results in flashing of part of the hot water with consequent cooling of the balance of the water. The steam formed by flashing is withdrawn from the turbine by conduit 126 and fed to exhaust steam line 24 to be condensed as previously described. The cooled and separated peak shaving cooling water is removed from turbine 122 by conduit 124 which delivers it to the hot well 36. The cooled water is then fed to the bottom of tank 50 by conduits 80, 84, 88 and 92 with valve 94 open and valve 90 closed. The turbine or expander 122 is calculated to produce 1500 HP in a 350 MW plant.

Figure 3:
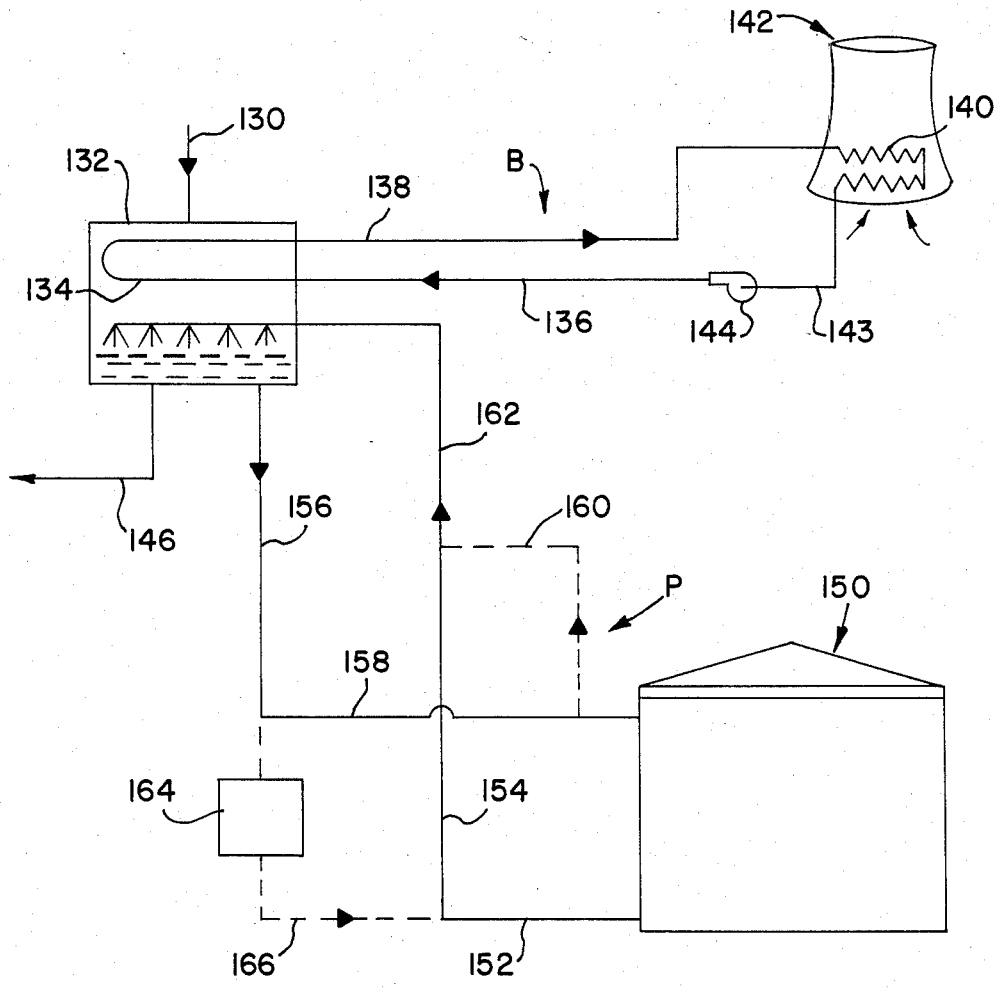
FIG. 3 is a diagrammatic drawing illustrating broadly a combination of apparatus provided by the invention in which exhaust steam in an electric generating plant is primarily condensed indirectly but in which peak shaving cooling is achieved using a reservoir of cold water following which the hot water so produced is cooled by feeding it to the exhaust steam vacuum.

The apparatus shown diagrammatically in FIG. 3 illustrates the invention in which the base cooling system B indirectly cools the exhaust steam while the peak shaving cooling system P is very much like that described above in connection with FIG. 1.

As shown in FIG. 3, conduit 130 delivers exhaust steam to steam box 132 under a pressure of about 5 to 15 inches of mercury absolute. Condenser 134 is located in steam box 132. Cooling fluid is supplied to condenser 134 by conduit 136. The cooling fluid can be water, ethylene glycol or a refrigerant such as ammonia circulating in a closed loop. Hot cooling fluid is delivered by condenser 134 to conduit 138 which feeds it to heat exchanger 140 in cooling tower 142 through which air flows by natural or forced draft. The cooled fluid exits heat exchanger 140 to conduit 143 which feeds it to pump or compressor 144 which in turn delivers it to conduit 136. The steam condensed in steam box 132 is removed by conduit 146 and returned to the boiler. This essentially completes the base indirect cooling system. However, the base cooling system is sized such that it is inadequate to provide all the cooling needed to condense the steam on very warm days so that a peak shaving cooling system is included in the system.

The peak shaving cooling system P includes a water storage tank 150 full of water. Conduit 152 removes cold water from the lower portion of tank 150 and delivers it to conduits 154, 162 which feed it as a spray into steam box 132 thereby condensing steam. The hot peak shaving cooling water is removed from steam box 132 by conduit 156 and delivered to conduit 158 which feeds it into the top part of tank 150. The peak shaving operation as described remains in operation as long as needed up to the maximum cooling capacity of the cold water in tank 150 available for cooling.

After the peak shaving cooling system is no longer needed to condense exhaust steam, it is necessary to cool the hot peak shaving cooling water in tank 150. This is accomplished when the air temperature is lower, such as at nighttime, and the base cooling system is functioning more efficiently, such as during daytime temperatures, by withdrawing hot water from tank 150 by conduit 160 and feeding it by conduit 162 into steam box 132. The hot water partly flashes since the steam box is under a pressure of about 5 to 15 inches of mercury absolute. This results in cooling of the hot water. The steam is condensed on condenser 134 to cold water. The cold water is removed from steam box 132 by conduit 156, fed through air cooled water chiller 164 to conduit 166 and by that conduit to conduit 152 which delivers it to the lower storage part of tank 150. During cooling of the peak shaving hot water in the described manner it should be understood that the temperature of the water formed by steam condensation in steam box 132 is no higher than the temperature of the peak shaving water following cooling therein by flashing.

The data in the following Table 1 illustrates operating conditions when the atmospheric air is at 95° F., 82° F. and 70° F. using a cooling system as described in conjunction with FIG. 1. At 95° F. the base cooling system is supplemented by the peak shaving cooling system; at 82° F. the base cooling system provides all the cooling needed and the peak shaving system is not used; and, at 70° F. the base cooling system is in use and provides excess cooling capacity so that the hot peak shaving cooling water can be regenerated or cooled by spraying it into the exhaust steam stream or its equivalent. The data in Table 1 sets a maximum turbine back pressure of 10 inches of mercury absolute.

TABLE 1

| FIG. 1 NO. | 14 | 22 | 24 | 34 | 38 | 31 | 33 | 56 | 66 | 80 | 89 | 92 | 100 |
|---|---|---|---|---|---|---|---|---|---|---|---|---|---|
| | | 365 MW Plant Operating With 100% Load at Ambient 95° F. (Peak Shaving Mode) | | | | | | | | | | | |
| TEMP. (°F.) | 161 | 161 | 161 | 161 | 161 | 95 | 137 | 110 | 110 | 161 | 161 | — | — |
| PRESSURE (PSIA) | 40 | 10"HgA | 10"HgA | 10"HgA | 10"HgA | 14.6 | 14.58 | 35 | 35 | 40 | 20 | — | — |
| FLOW (lb/Hr.) | 1.95 × $10^6$ | 1.95 × $10^6$ | 1.65 × $10^6$ | 1.65 × $10^6$ | 7.58 × $10^6$ | 160 × $10^6$ | 160 × $10^6$ | 5.63 × $10^6$ | 5.63 × $10^6$ | 5.63 × $10^6$ | 5.63 × $10^6$ | — | — |
| Remarks | | 1.90 × $10^9$ B/Hr rejected to steam | | Tower heat load is reduced by 0.29 × $10^9$ B/Hr | | 1.61 × $10^9$ B/Hr rejected to air | | | 0.29 × $10^9$ B/Hr transferred to water for storage | | | | |
| | | 365 MW Plant Operating With 100% Load at Ambient 82° F. (Normal Operation) | | | | | | | | | | | |
| TEMP. (°F.) | 159 | 159 | 159 | 159 | 159 | 82 | 131 | — | — | — | — | — | — |
| PRESSURE (PSIA) | 40 | 9.55"HgA | 9.55"HgA | 9.55"HgA | 9.55"HgA | 14.6 | 14.58 | — | — | — | — | — | — |
| FLOW (lb/Hr.) | 1.95 × $10^6$ | 1.95 × $10^6$ | 1.95 × $10^6$ | 1.95 × $10^6$ | 1.95 × $10^6$ | 164 × $10^6$ | 164 × $10^6$ | — | — | — | — | — | — |
| Remarks | | 1.9 × $10^9$ B/Hr rejected to steam | | | | 1.9 × $10^9$ B/Hr rejected to air | | | | | | | |
| | | 365 MW Plant Operating With 75% Load at Ambient 70° F. (Cooling Regeneration Mode) | | | | | | | | | | | |
| TEMP. (°F.) | 133 | 133 | 133 | 133 | 133 | 70 | 108 | — | 161 | 133 | — | 110 | 161 |
| PRESSURE (PSIA) | 40 | 4.97"HgA | 4.97"HgA | 4.97"HgA | 4.97"HgA | 14.6 | 14.58 | — | 35 | 40 | — | 35 | 14.7 |
| FLOW (lb/Hr) | 1.46 × $10^6$ | 1.46 × $10^6$ | 1.61 × $10^6$ | 1.61 × $10^6$ | 6.87 × $10^6$ | 168 × $10^6$ | 168 × $10^6$ | — | 5.41 × $10^6$ | 5.41 × $10^6$ | — | 5.41 × $10^6$ | 5.41 × $10^6$ |
| Remarks | | 1.4 × $10^9$ B/Hr rejected to steam | | Add 0.151 × $10^9$ B/Hr heat load to the cooling tower | | 1.55 × $10^9$ B/Hr rejected to air | | | 0.151 × $10^9$ B/Hr cooling by vaporizing water | | | 0.127 × $10^9$ B/Hr auxiliary cooling required | |

What is claimed is:

1. A method of condensing exhaust steam comprising:

conveying a stream of the exhaust steam under vacuum to a base cooling means to condense the steam in the base cooling means so long as the heat rejection capacity of the base cooling means is adequate to condense the steam;

supplementing the cooling capacity of the base cooling means, when it provides inadequate cooling to condense the steam, by contemporaneously also withdrawing cold cooling water from a cold water reservoir and injecting the cooling water into a portion of the stream of exhaust steam under vacuum to thereby condense a sufficient portion of the steam of water such that the remaining portion of the steam is condensed to water in the base cooling means;

withdrawing hot condensed water from the exhaust steam stream and feeding at least a portion thereof to a hot reservoir;

after supplementing the cooling capacity of the base cooling means as described, withdrawing hot cooling water from the hot reservoir, when the capacity of the base cooling means is at least adequate to decrease the temperature of the exhaust steam stream to below the temperature of the hot cooling water in the hot reservoir, and subjecting the withdrawn hot cooling water to the exhaust steam vacuum to thereby cool the hot cooling water by converting part of the water to steam; and feeding the so-cooled cooling water to the cold water reservoir.

2. A method according to claim 1 in which the exhaust steam temperature is about 120° to 180° F. at 5 to 15" mercury absolute pressure when cold cooling water is used to condense steam, and the exhaust steam temperature is about 110° F. to 150° F. when the hot cooling water is cooled by the steam, provided that the hot cooling water is hotter than the exhaust steam used to cool it.

3. A method according to claim 1 in which the hot cooling water, withdrawn from the hot reservoir, to be cooled is sprayed into contact with the steam.

4. A method according to claim 1 in which the hot cooling water withdrawn from the hot reservoir to be cooled is expanded through a turbine having its outlet in communication with the vacuum of the exhaust steam.

5. A method according to claim 4 in which the turbine is a two phase turbine and steam exiting the turbine is fed to the exhaust steam stream and cool water exiting the turbine is stored in the cold reservoir.

6. A method according to claim 1 in which the base cooling means is a cooling tower and exhaust steam is fed to the cooling tower and condensed therein.

7. A method according to claim 1 in which the base cooling means includes a steam box in which exhaust steam is condensed indirectly and the cold cooling water is sprayed into the steam box to aid in condensing steam.

8. A method according to claim 7 in which the hot cooling water to be cooled is sprayed into the steam box.

9. A method according to claim 1 in which the portion of hot condensed water withdrawn from the exhaust steam stream and fed to the hot reservoir is approximately equal to the amount of cold cooling water injected into the exhaust steam.

10. Apparatus comprising:

a steam driven turbine;

a cooling tower;

means for delivering an exhaust steam stream under vacuum from the turbine to the cooling tower;

a hot reservoir for cooling water when hot;

a cold reservoir for cooling water when cold;

means for withdrawing cold cooling water from the cold reservoir and feeding cold cooling water to the exhaust steam to condense a portion of the steam when the cooling capacity of the cooling tower is inadequate to cool all the exhaust steam;

means for withdrawing hot condensed water from the exhaust steam stream and feeding it to the hot reservoir;

means for withdrawing hot cooling water from the hot reservoir when the temperature of the exhaust steam stream decreases to below the temperature of the hot cooling water in the hot reservoir and delivering the hot cooling water to the exhaust steam stream under vacuum to thereby cool the hot cooling water; and means for delivering the resulting cold cooling water to the cold reservoir.

11. Apparatus according to claim 10 in which the means for withdrawing hot condensed water from the exhaust steam stream includes a conduit dimensioned to withdraw at least an amount of such water approximately equal to the amount of cooling water injected into the exhaust steam.

12. Apparatus according to claim 10 in which the means for withdrawing hot cooling water from the hot reservoir and delivering it to the exhaust steam stream includes a turbine or expander through which the hot cooling water flows and is partially flashed to steam thereby cooling the hot cooling water, and the turbine forms separate steam and cold cooling water streams.

13. Apparatus according to claim 12 including means to deliver the cold cooling water from the turbine outlet to the cold reservoir and to feed the steam from the turbine to the cooling tower.

14. Apparatus comprising:

a base cooling means;

means for delivering an exhaust steam stream under vacuum to the base cooling means;

a hot reservoir for cooling water when hot;

a cold reservoir for cooling water when cold;

means for withdrawing cold cooling water from the cold reservoir and feeding cold cooling water to the exhaust steam to condense a portion of the steam when the cooling capacity of the base cooling means is inadequate to cool all the exhaust steam;

means for withdrawing hot condensed water from the exhaust steam stream and feeding it to the hot reservoir;

means for withdrawing hot cooling water from the hot reservoir when the temperature of the exhaust steam stream decreases to below the temperature of the hot cooling water in the hot reservoir and delivering the hot cooling water to the exhaust steam stream under vacuum to thereby cool the hot cooling water; and means for delivering the resulting cold cooling water to the cold reservoir.

15. Apparatus according to claim 14 in which the means for withdrawing hot cooling water from the hot reservoir and delivering it to the exhaust steam stream includes a turbine through which the hot cooling water flows and is partially flashed to steam thereby cooling the hot cooling water.

16. Apparatus according to claim 15 in which the turbine or expander forms separate steam and cold cooling water streams and means is included to deliver the cold cooling water from the turbine outlet to the cold reservoir and to feed the steam from the turbine to the base cooling means.

* * * * *